US008055501B2

(12) United States Patent
Kuo et al.

(10) Patent No.: US 8,055,501 B2
(45) Date of Patent: Nov. 8, 2011

(54) SPEECH SYNTHESIZER GENERATING SYSTEM AND METHOD THEREOF

(75) Inventors: Chih-Chung Kuo, Hsinchu (TW); Min-Hsin Shen, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 1052 days.

(21) Appl. No.: 11/875,944

(22) Filed: Oct. 21, 2007

(65) Prior Publication Data

US 2008/0319752 A1 Dec. 25, 2008

(30) Foreign Application Priority Data

Jun. 23, 2007 (TW) ..... 96122781 A

(51) Int. Cl.
*G10L 13/00* (2006.01)

(52) U.S. Cl. ..... 704/258; 704/270

(58) Field of Classification Search ..... None
See application file for complete search history.

(56) References Cited

U.S. PATENT DOCUMENTS

| | | | | |
|---|---|---|---|---|
| 6,725,199 | B2 | 4/2004 | Brittan et al. | |
| 7,013,278 | B1 | 3/2006 | Conkie | |
| 7,013,282 | B2 | 3/2006 | Schrocter | |
| 7,062,439 | B2 | 6/2006 | Brittan et al. | |
| 7,328,157 | B1 * | 2/2008 | Chu et al. | 704/260 |
| 2003/0216921 | A1 * | 11/2003 | Bao et al. | 704/260 |
| 2005/0096909 | A1 * | 5/2005 | Bakis et al. | 704/260 |
| 2005/0256716 | A1 * | 11/2005 | Bangalore et al. | 704/260 |
| 2006/0287861 | A1 * | 12/2006 | Fischer et al. | 704/260 |
| 2007/0168193 | A1 * | 7/2007 | Aaron et al. | 704/260 |
| 2008/0091431 | A1 * | 4/2008 | Kuo et al. | 704/260 |
| 2008/0288256 | A1 * | 11/2008 | Agapi et al. | 704/260 |

OTHER PUBLICATIONS

"1st Office Action of China Counterpart Application" issued on Jul. 14, 2010, p. 1-p. 7.

* cited by examiner

*Primary Examiner* — Brian Albertalli
(74) *Attorney, Agent, or Firm* — Jianq Chyun IP Office

(57) ABSTRACT

A speech synthesizer generating system and a method thereof are provided. A speech synthesizer generator in the speech synthesizer generating system automatically generates a speech synthesizer conforming to a speech output specification input by a user. In addition, a recording script is automatically generated by a recording script generator in the speech synthesizer generating system according to the speech output specification, and a customized or expanded speech material is recorded according to the recording script. After the speech material is uploaded to the speech synthesizer generating system, the speech synthesizer generator automatically generates a speech synthesizer conforming to the speech output specification. The speech synthesizer then synthesizes and outputs a speech output at a user end.

18 Claims, 6 Drawing Sheets

SPEECH SYNTHESIZER GENERATING SYSTEM AND METHOD THEREOF

CROSS-REFERENCE TO RELATED APPLICATION

This application claims the priority benefit of Taiwan application serial no. 96122781, filed on Jun. 23, 2007. All disclosure of the Taiwan application is incorporated herein by reference.

BACKGROUND OF THE INVENTION

1. Field of the Invention

The present invention generally relates to a speech output system and a method thereof, in particular, to a speech synthesizer generating system and a method thereof.

2. Description of Related Art

The demands to automatic services and devices have been increasing along with the advancement of technologies, wherein speech output is one of the commonly demanded services. With speech guidance, less manpower is consumed and automatic services can be provided. High quality speech output is a common user interface required by various services. In particular, speech is the most natural, convenient, and secure information output in a mobile device having limited display screen. In addition, audio books provide a very efficient learning method, especially for learning a foreign language.

However, existing speech output methods can be categorized into two modes which respectively have their own disadvantages. Voice recording is one of the two modes, and which is time-consuming and has high cost and unchangeable speech output. Speech synthesis is the other speech output mode which provides low-quality and inflexible speech quality and is difficult to customize a speech.

Referring to FIG. 1, a system and method for text-to-speech processing in a portable device are provided by AT&T in U.S. Pat. No. 7,013,282. According to this method, a user 130 inputs some text into a desktop computer 110. Then the input text is converted by a text-to-speech (TTS) module 112 in the desktop computer 110. To be specific, the text is converted into a speech output 118 by a text analysis module 114 and a speech synthesis module 116. In this invention, the TTS conversion operation is performed by the desktop computer 110 which has high calculation capability, and the synthesized speech output 118 is transmitted from the desktop computer 110 to a handheld electronic device 120 having lower calculation capability. The speech output 118 output by the TTS module 112 includes a carrier phrase and a slot information and is transmitted to a memory of the handheld electronic device 120. The handheld electronic device 120 then concatenates and outputs these carrier phrases and slot information.

However, in foregoing disclosure, the content to be converted by the TTS module is unchangeable, which is very inflexible. In addition, the speech synthesis module in the desktop computer 110 for synthesizing the speech is also unchangeable. Moreover, the desktop computer 110 and the handheld electronic device 120 have to operate synchronously.

A speech synthesis apparatus and selection method are provided by HP in U.S. Pat. No. 6,725,199 and U.S. Pat. No. 7,062,439. A method for assessing speech quality is provided in these disclosures, wherein an "objective speech quality assessor" is used for generating a confidence score for a speech-form utterance, and the speech-form utterance having the best confidence score is selected among a plurality of TTS modules to improve the quality of the speech output. If there is only one TTS module, the text is rewritten into other texts having the same meaning and then the speech-form utterance of these rewritten texts having the best confidence score is selected as the speech output.

SUMMARY OF THE INVENTION

Accordingly, the present invention is directed to a new speech output system which balances between voice recording and speech synthesis. In other words, the speech output system can provide flexible speech output, high speech quality, low cost, and customized speech.

The present invention is directed to a speech synthesizer generating system including a source corpus and a speech synthesizer generator, wherein the speech synthesizer generator automatically generates a speech synthesizer conforming to a speech output specification input by a user.

According to an embodiment of the present invention, the speech synthesizer generating system further includes a recording script generator and a synthesis unit generator. A recording script can be automatically generated by the recording script generator according to the speech output specification, and a customized or expanded speech material is recorded according to the recording script. After the speech material is uploaded to the speech synthesizer generating system, the synthesis unit generator converts the speech material into speech synthesis units and combines those into the source corpus. After that, the speech synthesizer generator automatically generates a speech synthesizer conforming to the speech output specification.

The present invention provides a speech synthesizer generating system including a source corpus, a speech synthesizer generator, a recording script generator, and a synthesis unit generator. The source corpus stores a plurality of synthesis units. The speech synthesizer generator receives a speech output specification and generates a speech synthesizer after selecting synthesis units from the source corpus according to the speech output specification. The recording script generator receives the speech output specification and generates a recording script so that a customized or expanded speech material can be recorded according to the recording script. The synthesis unit generator generates a plurality of synthesis units conforming to the speech output specification according to the speech material and transmits the synthesis units to the source corpus so that the speech synthesizer generator can selectively update the speech synthesizer according to the synthesis units generated from the customized or expanded speech material.

The present invention provides a speech synthesizer generating method including following steps. A recording script is generated according to a speech output specification. A recording interface is generated according to the recording script. A plurality of synthesis units are generated through the recording interface according to a customized or expanded speech material, and the synthesis units are input into a source corpus. A speech synthesizer conforming to the speech output specification is generated according to the source corpus.

BRIEF DESCRIPTION OF THE DRAWINGS

The accompanying drawings are included to provide a farther understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
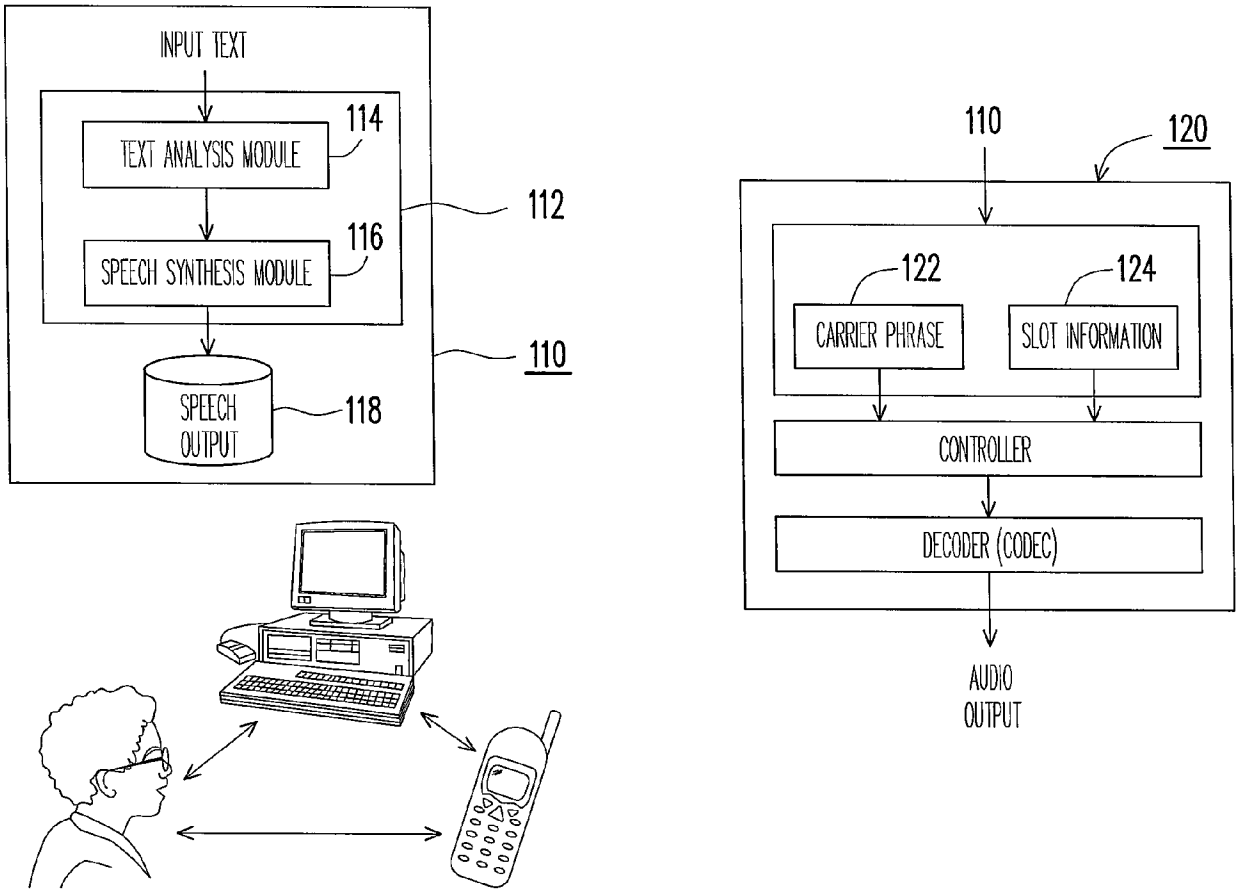
FIG. 1 is a diagram of a conventional text-to-speech (TTS) system in a portable device.

Reference will now be made in detail to the present preferred embodiments of the invention, examples of which are illustrated in the accompanying drawings. Wherever possible, the same reference numbers are used in the drawings and the description to refer to the same or like parts.

The present invention provides a new speech output system which balances between voice recording and speech synthesis. In other words, the system offers both flexibility and high quality in output speech, and in this system, speech can be customized easily and the cost of voice recording is reduced. The system resolves the problems of existing two speech output modes: the high time-consumption, high production cost, and inflexibility in speech output of voice recording and the low speech quality and difficulty in speech customization of speech synthesis.

The present invention provides a new speech output system, wherein the text content to be converted is not limited so that a customized speech output service is provided. The speech output system includes a speech synthesis engine at a user end and a service-specific speech synthesis unit inventory. A customer may be a personal user or a service provider who can download a desired speech output module by uploading a standard speech output specification to the speech output system.

Figure 2:
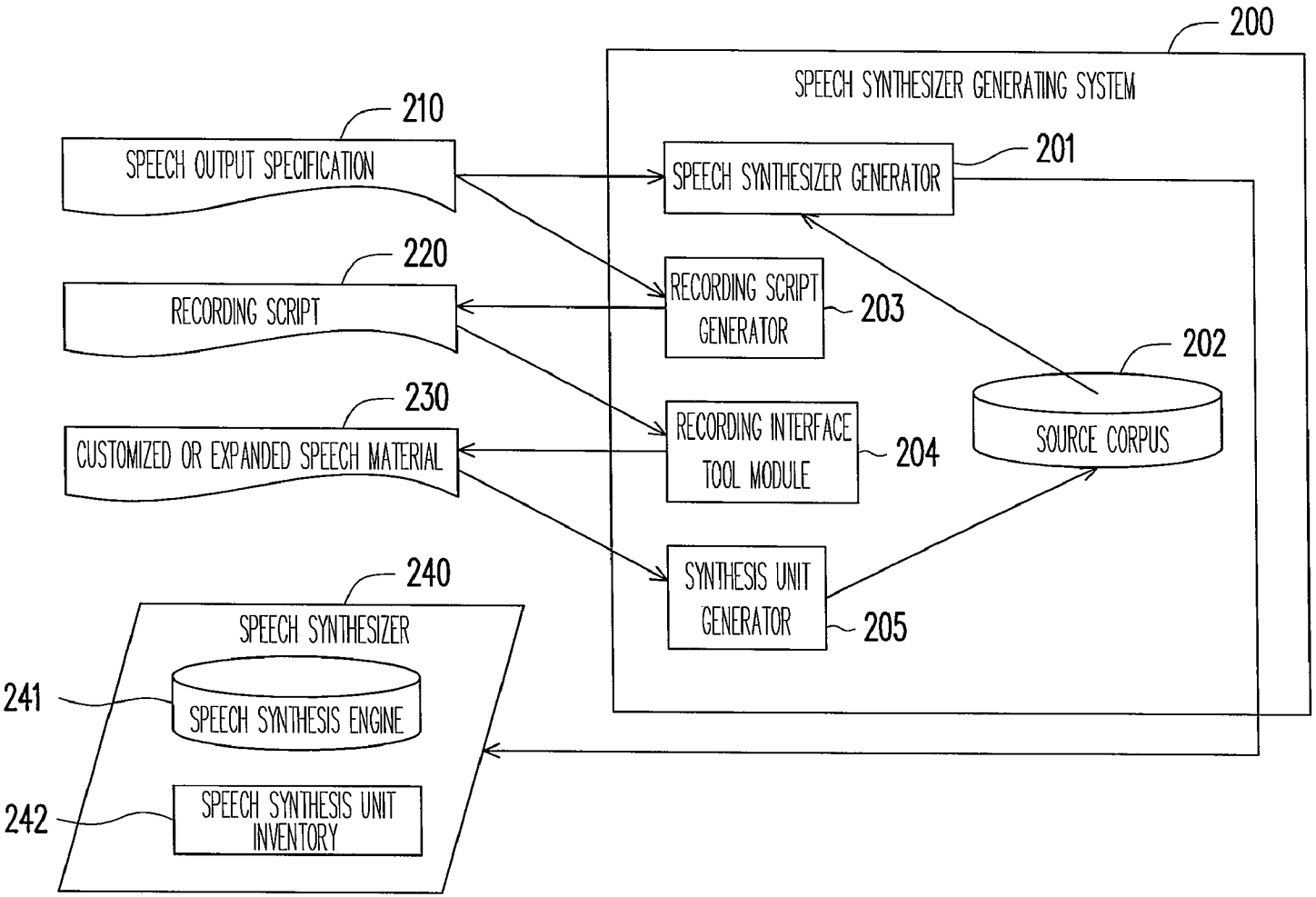
FIG. 2 is a diagram illustrating the structure of a speech synthesizer generating system according to an embodiment of the present invention.

FIG. 2 is a diagram illustrating the structure of a speech synthesizer generating system according to an embodiment of the present invention. The speech synthesizer generating system 200 includes a large source corpus 202 containing all the phonetic units of a target language. A speech is output by a speech synthesizer 240 at a user end, wherein the speech synthesizer 240 includes a speech synthesis engine 241 and a service-specific speech synthesis unit inventory 242. The speech synthesizer generating system 200 may be used by a personal user or a service provider. A user can download the desired speech synthesizer 240 by uploading a speech output specification 210 into the speech synthesizer generator 201 of the speech synthesizer generating system 200.

If the user wants to establish the speech synthesizer 240 with the voice of a desired speechmaker, the speech synthesizer generating system 200 automatically generates a recording script 220 according to the speech output specification 210 input by a recording script generator 203. The user records a customized or expanded speech material 230 according to the recording script 220 and uploads the speech material 230 to the speech synthesizer generating system 200. Speech synthesis units are generated by the synthesis unit generator 205 based on the speech material 230 and the speech synthesis units are transmitted to the source corpus 202. The speech synthesizer generator 201 updates the speech synthesizer 240 according to the source corpus 202 so that the user can download the speech synthesizer 240 generated with the voice of the desired speechmaker.

Speech Output Specification

Figure 3:
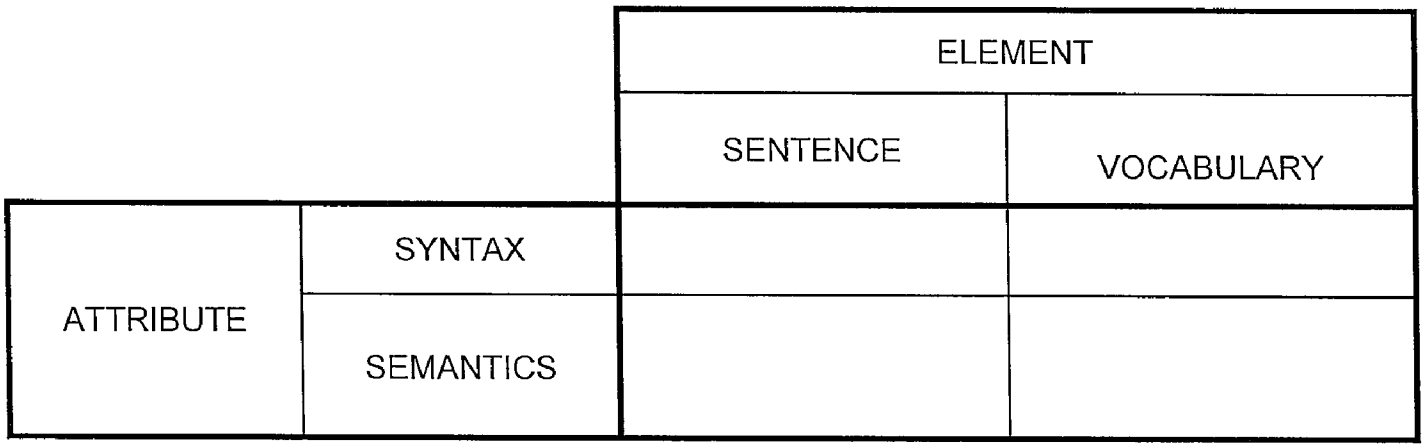
FIG. 3 is a diagram illustrating the format of a speech output specification according to an embodiment of the present invention.

FIG. 3 is a diagram illustrating the format of a speech output specification according to an embodiment of the present invention. Referring to FIG. 3, a speech output specification contains has to describe all the texts to be converted into speech in detail. A description includes several elements, such as a sentence pattern or a vocabulary. The attribute of the description includes syntax pattern or semantics pattern etc.

The pattern for describing a sentence pattern may be:

syntax: template-slot/syntax tree/context free grammar/regular expression etc, semantics: question/interrogation/statement/command/affirmation/denial/exclamation . . . etc.

The pattern for describing a vocabulary may be:

syntax: exhaustion/alphanumeric character set/regular expression etc, semantics: proper nouns (name of person/name of place/name of city . . . ), numbers (phone number/amount/time . . . ) etc.

For example, if the speech output specification input by a user is a temperature inquiry, the temperature inquiry is described in template-slot as:

Sentence pattern: Temperature of <city><date> is <tempt> degrees

Vocabulary:

| | |
|---|---|
| <city>syntax: c(1..8) | semantics: name |
| <date>syntax: not available | semantics: date:md |
| <tempt>syntax: d(0..99) | semantics: number |

Or the temperature inquiry may also be described in grammar as:

Sentence pattern: Temperature of S→NP is <tempt> degrees

*NP*→<city><date>|<date><city>

Followings are some examples of the sentence to be generated based on foregoing text description:

Temperature of HsinChu October, 3$^{rd}$ is 27 degrees

Temperature of October, 3$^{rd}$ HsinChu is 27 degrees

The format of the speech output specification provided by a user is not limited to foregoing embodiments but can be adjusted according to the requirement of the speech synthesizer generating system 200.

Besides describing the content of the speech, a user may also describe a software/hardware platform for executing the speech synthesizer and the conditions of the speechmaker (for example, nationality, sex, age, education, speech features, and recording samples) in the speech output specification.

Speech Synthesizer Generator

Figure 4:
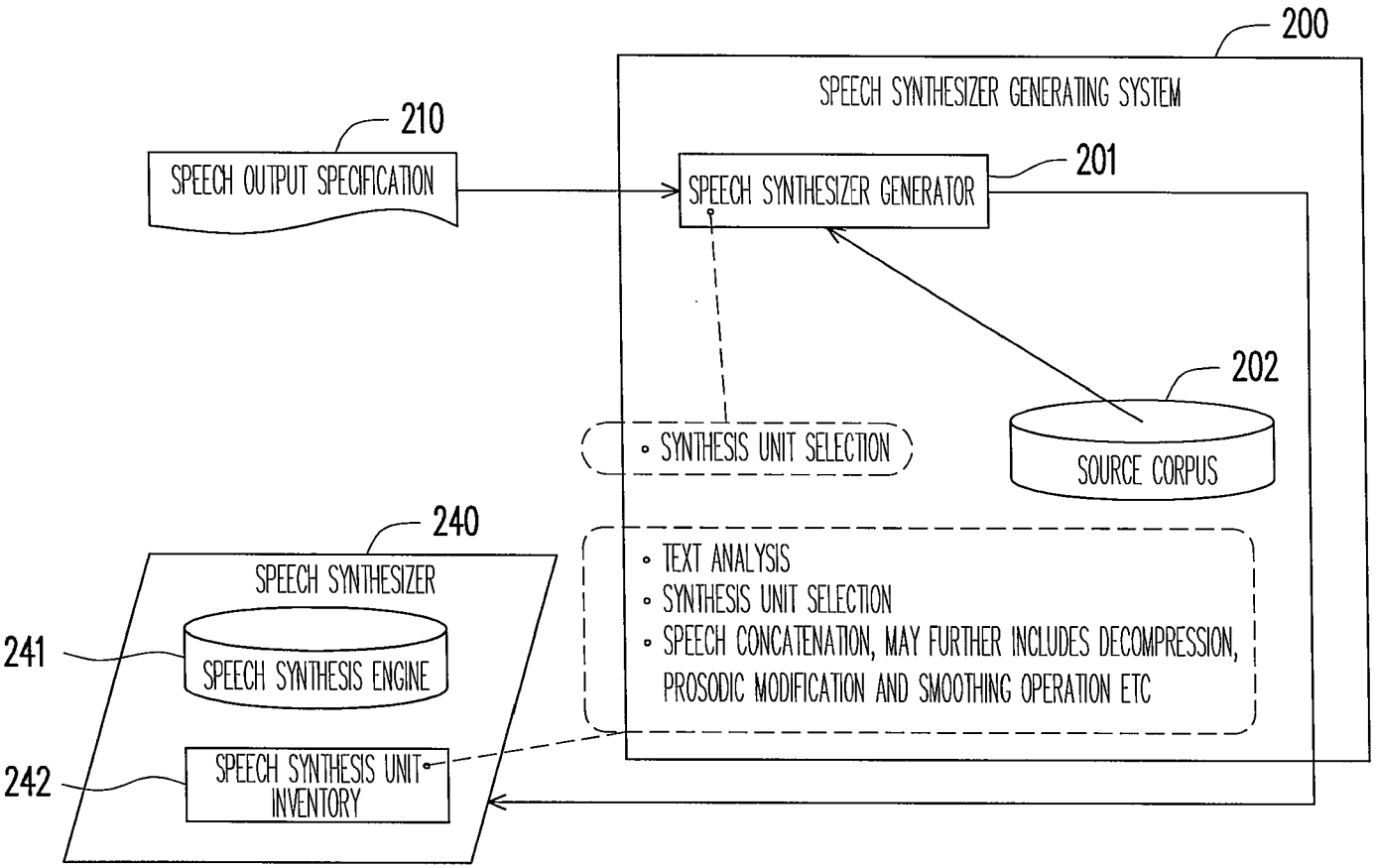
FIG. 4 is a diagram illustrating a method for generating a speech synthesizer generator, a speech synthesis engine, and a speech synthesis unit inventory according to an embodiment of the present invention.

FIG. 4 is a diagram illustrating a method for generating a speech synthesizer generator, a speech synthesis engine, and a speech synthesis unit inventory according to an embodiment of the present invention. Referring to FIG. 4, first, the speech synthesizer generator 201 automatically generates an optimal speech synthesis unit inventory 241 from a large source corpus 202 according to the speech output specification 210 provided by a user.

In an embodiment of the present invention, the speech output specification can be described with extensible markup language (XML), the source corpus contains all the phonetic unitss of the target language, and the speech synthesis generator and the user-end speech synthesis engine are implemented through the unit selection method in conventional concatenation speech synthesis technique. According to the unit selection method, first, N optimal candidate speech units are generated through text analysis (for example, by minimizing following equation (1)). Then, the costs of the candidate speech units are calculated (for example, following equation (2) regarding acoustic distortion, equation (3) regarding speech concatenation cost, and equation (4) regarding total cost). After that, the candidate speech units having the least cost are selected as the optimal units through, for example, Viterbi search algorithm. These optimal units form the speech synthesis unit inventory, and whether the speech synthesis unit inventory is further compressed is determined according to the actual requirement.

The corpus selection of the speech synthesis engine 242 may also follow foregoing steps and a text analysis and a speech concatenation step, wherein the speech concatenation step may further include a decompression, a prosodic modification, or a smoothing step.

As described above, according to an embodiment of the present invention, the speech synthesis unit inventory and speech synthesis engine generated by the speech synthesizer generator form a specific speech synthesizer conforming to the speech output specification provided by the user.

Linguistic distortion < Equation (1) >

$$\begin{aligned} CUVdist(U_i^l, L_i^l) = {} & w_0 * LToneCost(U_i^l \cdot lTone, L_i^l \cdot lTone) + \\ & w_1 * RToneCost(U_i^l \cdot rTone, L_i^l \cdot rTone) + \\ & w_2 * LPhoneCost(U_i^l \cdot lPhone, L_i^l \cdot lTone) + \\ & w_3 * RPhoneCost(U_i^l \cdot rPhone, L_i^l \cdot rPhone) + \\ & w_4 * IntraWord(U_i^l, L_i^l) + w_5 * IntraSentence(U_i^l, L_i^l) \end{aligned}$$

In foregoing equation (1), "U" is the speech synthesis unit inventory, "L" is the linguistic features of the input text, "l" is the length of a speech synthesis unit, and "i" is a syllable index in a currently processed sentence, wherein "i+l" is smaller than or equal to the syllable count in the currently processed sentence. LToneCost, RToneCost, LPhoneCost, RPhoneCost, IntraWord, and IntraSentence are all unit distortion functions of a speech synthesis unit.

Acoutic(target) distortion < Equation (2) >

$$C^t(U_i^l, A_i^l) = \sum_{j=i}^{i+l} \left\{ \begin{array}{l} w_0 * \left| \log\left( \frac{a_{A_j}^0}{a_{U_j}^0} \right) \right| + w_1 * \sum_{p=1}^{3} \left| \log\left( \left| \frac{a_{A_j}^p}{a_{U_j}^p} \right| \right) \right| + \\ w_2 * \left| \log\left( \frac{\text{Initial}_{A_j}}{\text{Initial}_{U_j}} \right) \right| + w_3 * \left| \log\left( \frac{\text{Final}_{A_j}}{\text{Final}_{U_j}} \right) \right| \end{array} \right\}$$

In foregoing equation (2), "U" is the speech synthesis unit inventory, "A" is the acoustic features of the input text, "l" is the length of a speech synthesis unit, a0~a3 are Legendre polynomial parameters, "i" is a syllable index in a currently processed sentence, and "i+l" is the syllable count in the currently processed sentence.

Concatenation cost < Equation (3) >

$$\begin{aligned} C^c(U_{i-1}, U_i) = {} & W_{mel} * \frac{1}{\text{ORDER}} \sum_{p=1}^{ORDER} \left( MelCep\left( U_{i-1}^{R_p}, U_i^{L_p} \right) \right)^2 + \\ & W_{pth} * \left| \log\left( \frac{a_{U_{i-1}}^0}{a_{U_i}^0} \right) \right| + W_{cuv} * CUVcost(U_{i-1}, U_i) \end{aligned}$$

$$\begin{aligned} CUVcost(U_{i-1}, U_i) = {} & w_0 * LToneCost(U_{i-1} \cdot Tone, U_i \cdot lTone) + \\ & w_1 * RToneCost(U_{i-1} \cdot rTone, U_i \cdot Tone) + \\ & w_2 * LPhoneCost(U_{i-1} \cdot Phone, U_i \cdot lPhone) + \\ & w_3 * RPhoneCost(U_{i-1} \cdot rPhone, U_i \cdot Phone) \end{aligned}$$

In foregoing equation (3), "ORDER" is 12, "Rp" is the Mel-Cepstrum of the last frame at an end side, "Lp" is the Mel-Cepstrum of the first frame at a beginning side, "a0" is a pitch, and LToneCost, RToneCost, LPhoneCost, and RPhoneCost are all unit distortion functions of a speech synthesis unit.

Total Cost < Equation (4) >

$$C(t_1^n, u_1^n) = W^t \sum_{i=1}^{n} C^t(t_i, u_i) + W^c \left( \sum_{i=2}^{n} C^c(u_{i-1}, u_i) + C^c(s, u_1) + C^c(u_n, s) \right)$$

In foregoing equation (4), "n" is the syllable count in the currently processed sentence, "Ct" is a target distortion value, "Cc" is the concatenation cost, "Cc(s, u1)" is the first speech synthesis unit to be converted into silence, and "Cc(un, s)" is the last speech synthesis unit to be converted into silence.

Recording Script Generator and Synthesis Unit Generator

A recording script generator, a synthesis unit generator, a speech synthesizer generator, and a method for generating a speech synthesis engine and a speech synthesis unit inventory will be described below with reference to FIG. 2.

In the present embodiment, the recording script generator 203 automatically generates an efficient recording script according to a speech output specification 210 provided by a user. The user can record a customized or expanded speech material 230 by using a recording interface tool module 204 according to the recording script. The customized or expanded speech material 230 is input to the synthesis unit generator 205, and speech synthesis units are generated based on the customized or expanded speech material 230 and combined into the source corpus 202. After that, a speech synthesis unit inventory 242 is generated by the speech synthesizer generator 240 through the method described above, and the user can download the speech synthesis unit inventory 242 or create a new speech synthesizer 240.

In an embodiment of the present invention, the speech output specification can be written in XML. First, a text analysis is performed to the speech output specification to obtain following information:

X: all the text to be converted into speeches $X_s$: the text covered by the recording script U: the unit types of all the text to be converted into speeches $U_s$: the unit types covered by the recording script X': all the text that can be generated by $U_s$.

As described above, $X_s \subset X \subset X'$ and $U_s \subset U$. Accordingly, the covering rate $r_C$ and hit rate $r_H$ can be further defined as:

$$r_C = \frac{|Us|}{|U|} \quad \text{< Equation (5) >}$$

$$r_H = \frac{|X'|}{|X|} \quad \text{< Equation (6) >}$$

$r_C$, $r_H$, and recording script space limitation $|X_s|$ are three script selection rules.

The selection of algorithm is determined according to the type of the synthesis units. Regarding Chinese language, the synthesis units thereof can be categorized into toneless syllables, tone syllables, context tone syllables etc. The synthesized speech of a text is generated completely if there is no tone (toneless) syllable in X Thus, multi-stage selection can be used for selecting an algorithm and the selection at each stage is optimized according to the synthesis unit type and the script selection rules ($r_C$, $r_H$, and $|X_s|$) to generate a recording script conforming to the speech output specification provided by the user.

The recording script generator may also adopt the content disclosed in Taiwan Patent No. I247219 of the same applicant or the content disclosed in U.S. patent Ser. No. 10/384,938. The contents of foregoing two patents will be brought into the present disclosure with being described herein.

The synthesis unit generator may also adopt the content disclosed in Taiwan Patent No. I220511 of the same applicant or the content disclosed in U.S. patent Ser. No. 10/782,955. The contents of foregoing two patents will be brought into the present disclosure with being described herein.

In overview, the present invention provides a speech synthesizer generating system including a source corpus, a speech synthesizer generator, a recording script generator, and a synthesis unit generator. A user inputs a speech output specification to the speech synthesizer generating system, and the speech synthesizer generator automatically generates a speech synthesizer conforming to the speech output specification. A recording script may also be generated by a recording script generator according to the speech output specification, and the user can record a customized or expanded speech material according to the recording script. Then the speech material is uploaded to the speech synthesizer generating system. The synthesis unit generator generates speech synthesis units based on the speech material, and the speech synthesis units are combined into the source corpus. After that, the speech synthesizer generator automatically generates a speech synthesizer conforming to the speech output specification. The speech synthesizer generates a speech output at the user side. Please refer to FIG. 5A and FIG. 5B for foregoing system operation flow.

Figure 5A:
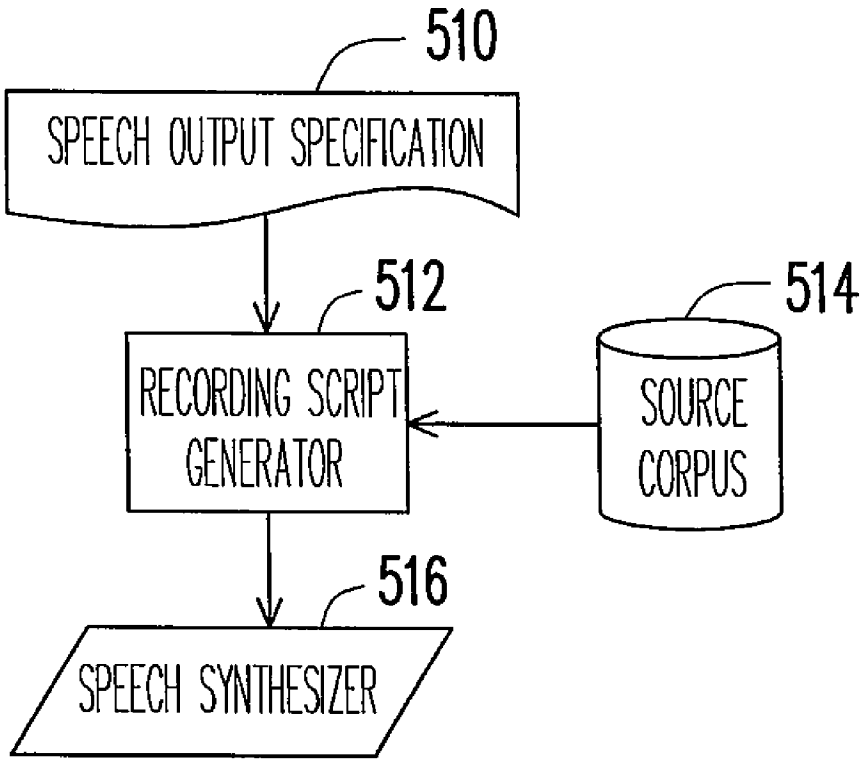
FIG. 5A and FIG. 5B are respectively system operation flowcharts according to embodiments of the present invention.
Figure 5B:
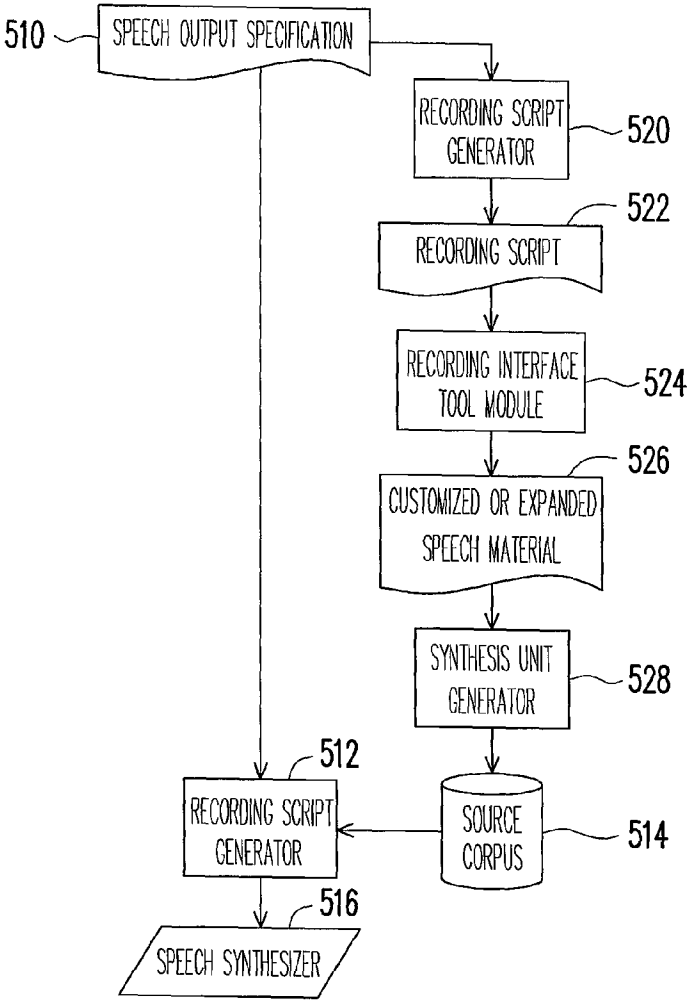

FIG. 5A is a system operation flowchart according to an embodiment of the present invention. Referring to FIG. 5A, first, a speech synthesizer 516 is generated according to a speech output specification 510 by a speech synthesizer generator 512 with reference to a source corpus 514. In addition, FIG. 5B is a system operation flowchart according to another embodiment of the present invention. Referring to FIG. 5B, a speech synthesizer 516 is also generated according to a speech output specification 510 by a speech synthesizer generator 512 with reference to a source corpus 514. However, this flowchart further describes following steps. A recording script generator 520 is generated according to the speech output specification 510, and the recording script generator 520 generates a recording interface tool module 524 according to a recording script 522. Next, a synthesis unit generator 528 is completed according to a customized or expanded speech material 526, and the synthesis unit generator 528 is input to the source corpus 514. After that, the speech synthesizer 516 conforming to the speech output specification 510 is generated according to the source corpus 514.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A speech synthesizer generating system, comprising:

a speech output specification, describing a plurality of sentence patterns and a plurality of vocabularies desired to be synthesized, a software or a hardware platform for a speech synthesizer, and conditions of a speaker;

a source corpus of a target language, comprising a plurality of phonetic units of the target language; and a speech synthesizer generator, receiving the speech output specification and generating a speech synthesizer being executed on an appointed platform after selecting a plurality of synthesis units from the source corpus according to the speech output specification, wherein the speech synthesizer comprises a speech synthesis unit inventory and a speech synthesis engine.

2. The speech synthesizer generating system according to claim 1, wherein the sentence pattern and the vocabulary in the speech output specification are defined according to syntax patterns or semantics patterns.

3. The speech synthesizer generating system according to claim 2, wherein the syntax pattern for defining the sentence pattern in the speech output specification is conducted by a template-slot pattern, a syntax tree pattern, a context free grammar pattern, or a regular expression pattern.

4. The speech synthesizer generating system according to claim 2, wherein the semantics pattern for defining the sentence pattern in the speech output specification is conducted by a pragmatic pattern comprising one of a question, an interrogation, a statement, a command, an affirmation, a denial, or an exclamation.

5. The speech synthesizer generating system according to claim 2, wherein the syntax pattern for defining the vocabulary in the speech output specification is one of exhaustion, alphanumeric character set, and regular expression.

6. The speech synthesizer generating system according to claim 2, wherein the semantics pattern for defining the vocabulary in the speech output specification uses a name of person, a name of place, a title of organization, a name of city for defining proper nouns, or uses one or more available phone numbers, an amount, or time for defining numbers.

7. A speech synthesizer generating system, comprising:

a speech output specification, describing a plurality of sentence patterns and a plurality of vocabularies desired to be synthesized, a software or a hardware platform for a speech synthesizer, and conditions of a speaker;

a source corpus of a target language, comprising a plurality of phonetic units of the target language;

a recording script generator, receiving the speech output specification and generating a recording script according to the speech output specification so that a customized or expanded speech material is recorded according to the recording script;

a recording interface tool module, for recording the customized or expanded speech material;

a synthesis unit generator, receiving the customized or expanded speech material, converting the speech material into speech synthesis units, and combining the synthesis units into the source corpus; and a speech synthesizer generator, receiving the speech output specification and generating a speech synthesizer which can be executed on an appointed platform after selecting a plurality of synthesis units from the source corpus according to the speech output specification, wherein the speech synthesizer comprises a speech synthesis unit inventory and a speech synthesis engine.

8. The speech synthesizer generating system according to claim 7, wherein the sentence pattern and the vocabulary in the speech output specification are defined according to syntax patterns or semantics patterns.

9. The speech synthesizer generating system according to claim 8, wherein the syntax pattern for defining the sentence pattern in the speech output specification is conducted by a template-slot pattern, a syntax tree pattern, a context free grammar pattern, or a regular expression pattern.

10. The speech synthesizer generating system according to claim 8, wherein the semantics pattern for defining the sentence pattern in the speech output specification is conducted by a pragmatic pattern comprising one of a question, an interrogation, a statement, a command, an affirmation, a denial, or an exclamation.

11. The speech synthesizer generating system according to claim 8, wherein the syntax pattern for defining the vocabulary in the speech output specification is conducted by exhaustion, alphanumeric character set, or regular expression.

12. The speech synthesizer generating system according to claim 8, wherein the semantics pattern for defining the vocabulary in the speech output specification uses a name of person, a name of place, a title of organization, a name of city for defining proper nouns, or uses one or more available phone numbers, an amount, or time for defining numbers.

13. A speech synthesizer generating method adapted for an electronic device, comprising:

generating a recording script by a recording script generator according to a speech output specification, wherein the speech output specification describes a plurality of sentence patterns and a plurality of vocabularies desired to be synthesized, a software or a hardware platform for the speech synthesizer, and conditions of a speaker;

generating a recording interface by a recording interface tool module according to the recording script;

generating a plurality of synthesis units through the recording interface according to a customization requirement or a expanded speech material and inputting the synthesis units into a source corpus by a synthesis unit generator; and generating the speech synthesizer conforming to the speech output specification by a speech synthesizer generator according to the source corpus.

14. The speech synthesizer generating method according to claim 13, wherein the speech output specification describes a plurality of sentence patterns and a plurality of vocabularies desired to be synthesized, and the sentence pattern and the vocabulary in the speech output specification are defined in syntax patterns or semantics patterns.

15. The speech synthesizer generating method according to claim 14, wherein the syntax pattern for defining the sentence pattern is conducted by a template-slot pattern, a syntax tree pattern, a context free grammar pattern, or a regular expression pattern.

16. The speech synthesizer generating method according to claim 14, wherein the semantics pattern for defining the sentence pattern is conducted by a pragmatic pattern comprising a pragmatic pattern comprising one of a question, an interrogation, a statement, a command, an affirmation, a denial, or an exclamation.

17. The speech synthesizer generating method according to claim 14, wherein the syntax pattern for defining the vocabulary is conducted by exhaustion, alphanumeric character set, or regular expression.

18. The speech synthesizer generating method according to claim 14, wherein the semantics pattern for defining the vocabulary uses a name of person, a name of place, a title of organization, a name of city for defining proper nouns, or uses one or more available phone numbers, an amount, or time for defining numbers.

* * * * *